United States Patent [19]

Achelpohl

[11] 3,979,049

[45] Sept. 7, 1976

[54] CROSS-BOTTOM BAG

[75] Inventor: Fritz Achelpohl, Lengerich of Westphalia, Germany

[73] Assignee: Windmoller & Holscher, Lengerich of Westphalia, Germany

[22] Filed: May 8, 1974

[21] Appl. No.: 468,168

[30] Foreign Application Priority Data

May 10, 1973 Germany ..... 2323726

[52] U.S. Cl. ..... 229/60; 229/55

[51] Int. Cl.[2] ..... B65D 33/02; B65D 33/22

[58] Field of Search ..... 229/55, 57, 58, 59, 229/60, 62

[56] References Cited

UNITED STATES PATENTS

| | | | |
|---|---|---|---|
| 3,220,635 | 11/1965 | Kasting et al. | 229/57 |
| 3,343,463 | 9/1967 | Nielsen et al. | 229/59 |
| 3,581,978 | 6/1971 | Kappelhoff et al. | 229/57 |

FOREIGN PATENTS OR APPLICATIONS

| | | | |
|---|---|---|---|
| 1,922,826 | 12/1970 | Germany | 229/57 |
| 330,607 | 10/1935 | Italy | 229/60 |
| 63,355 | 6/1949 | Netherlands | 229/60 |

*Primary Examiner*—William Price
*Assistant Examiner*—Bruce H. Bernstein
*Attorney, Agent, or Firm*—Fleit & Jacobson

[57] ABSTRACT

A cross-bottom bag having one end closed by fold portions of the bag which are tucked and folded over to close said one end, a cover sheet adhesively secured to the tucked and folded portions, a heat-meltable material provided on said tucked and folded portions before they are folded over and a heat-meltable material provided on said cover sheet in contact with the heat-meltable material provided on the corner tucks in the region between diagonal fold edges of the fold portions.

2 Claims, 2 Drawing Figures

CROSS-BOTTOM BAG

BACKGROUND OF THE INVENTION

This invention relates to a bag having one end closed by end portions of the bag which are tucked and folded over to close said one end, a cover sheet being adhesively secured to the tucked and folded portions of the bottom. Such bags are known as cross-bottom bags.

It is already known from the practice of producing such cross-bottom bags, in particular from plastics foil, for a hot-setting adhesive which is referred to as a "hot melt" to be applied in strip form to the two corner tucks of each bottom, after the bottom square has been formed, before the side fold portions of the bottom are folded over. The length of the hot-setting adhesive coating is such that a portion thereof projects beyond the subsequent bottom fold edges of the bottom side fold portions. Subsequently, the bottom side fold portions are folded about the above-mentioned bottom fold edges, and finally a bottom cover sheet which is coated with adhesive on one side is stuck to the bottom folding, over the complete area thereof. In cross-bottom bags produced in this way, the entire sealing of the bottom as regards trickle losses, the ingress of rain water or dust or the like, is effected on the one hand by the hot melt strip on the bottom corner tucks and on the other hand by the bottom cover sheet which is applied last. The sealing action which is produced in this way has been found insufficient in practice. In particular, it has not been possible to produce cross-bottom bags which are absolutely dust-tight and which are protected from the ingress of rain water or moisture, and this has a particularly disadvantageous effect when for example fertiliser agents in dust form are to be stored in open country, which agents should naturally not come into contact with moisture which would result in lumps being formed. The same also applies as regards many other critical substances to be contained in the bags. The reason for the defective sealing in cross-bottom bags produced in the above manner is inter alia that the plastics film used in practice is generally of low folding endurance, which also is true as regards certain kinds of paper which are used for the production of paper bags, and the effective restoration forces of the relatively stiff bag material, after securing the bottom side fold portions, must be resisted alone by the coating of hot melt which was applied at the beginning to the bottom corner tucks. The above-mentioned restoration forces cannot be completely carried at the critical points at which the diagonal fold edges of the bottom side fold portions cross with the strips of hot melt, if the bottom cover sheet which is coated on one side has been fitted, as in the time between applying the strips of hot melt and fitting the bottom cover sheet the surface of the hot melt coating has already cooled to such an extent that an intimate connection between the hot melt coating and the coating of adhesive on the bottom cover sheet is no longer ensured, the coating of adhesive on the bottom cover sheet comprising a different adhesive composition from the hot melt. The consequence of this is that free passages which are not stuck occur between the inside and outside of the bag, particularly in the region between the diagonal fold edges of the bottom side fold portions in which the hot melt coating comes into direct contact with the bottom cover sheet. These free passages permit the material contained in the bag to escape, particularly when it is a dusty material, and permit moisture to penetrate into the interior of the bag.

SUMMARY OF THE INVENTION

An embodiment of the invention aims to provide a cross-bottom bag of the kind first mentioned above, so as to exclude the formation of passages into the interior of the bag.

According to the present invention there is provided a cross-bottom bag having one end closed by fold portions of the bag which are tucked and folded over to close said one end, a cover sheet adhesively secured to the tucked and folded portions, a heat-meltable material provided on said tucked and folded portions before they are folded over and a heat-meltable material provided on said cover sheet in contact with the heat-meltable material provided on the corner tucks in the region between diagonal fold edges of the fold portions.

Due to the additional hot melt coating on the underside of the bottom cover sheet and the direct contact between the two coatings of hot melt, at least in the region of the critical points, an extremely high degree of holding force is attained, even when the outside skin of the strip of hot melt on the bottom corner tucks has already cooled a little when the bottom cover sheet is applied. Tests in practice have shown that the holding forces as between the two coatings of hot melt are quite considerably higher than the holding forces between a coating of hot melt and an adhesive agent of another composition. The formation of passages between the inside and outside of the bag is completely excluded by means of the invention. The advantages achieved are in practice so much more outstanding when teachings have been given to use quite definite coatings of adhesive, for the bottom cover sheets, which are of a different composition from the hot melt coating which is applied to the bottom corner tucks before the bottom side fold portions are folded over.

The coatings of hot melt preferably comprise strips which extend transversely to the longitudinal direction of the bag bottom, and which can be produced in the bag-producing machine in a particularly simple manner and without high machine expenditure.

In accordance with a particularly advantageous further proposal according to the invention, the coating of hot melt on the bottom cover sheet in the finished cross bottom extends on both sides beyond the diagonal fold edges of the bottom side fold portions. This provides that in any case the particularly critical points of crossing as between the hot melt coating on the bottom corner tucks and the diagonal fold edges of the bottom side fold portions, where the restoration forces of the folded material are particularly high, are absolutely sealed and additionally secured.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail certain illustrative embodiments of the invention, these being indicative however, of but ways in which the principle of the invention may be employed.

In said annexed drawings.

DESCRIPTION OF PREFERRED EMBODIMENTS

Figure 1:
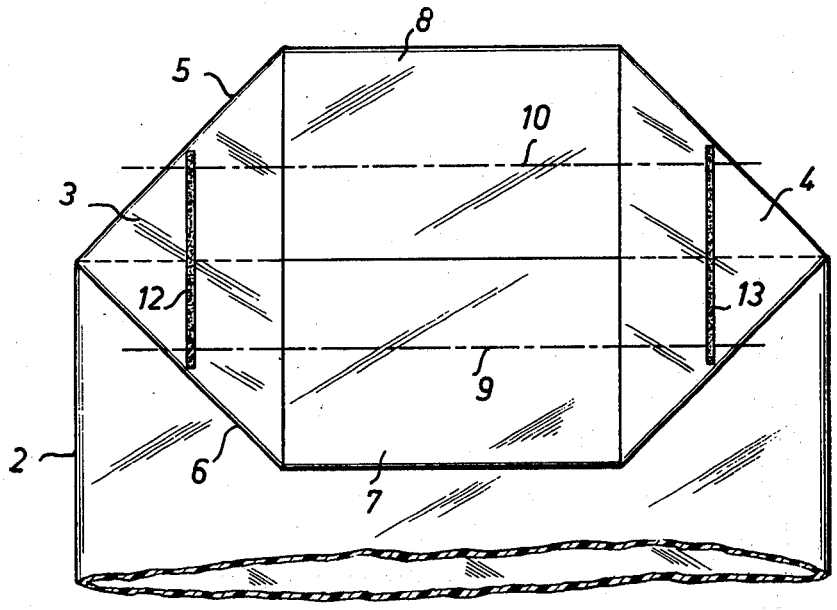
FIG. 1 shows a part of a cross-bottom bag in the region of one bottom end in a stage of production after applying a strip of hot melt material to the bottom corner tucks but before the bottom side fold portions are folded over.

It is known that a preparatory step in forming a cross bottom, denoted generally at 1, of a cross-bottom bag 2, is forming the end of a tube portion into a so-called bottom square. When this is done there are produced triangular bottom corner tucks 3 and 4 and, if the end of the bag tube portion does not have any longitudinal incisions, bottom side fold portions 7 and 8 which are delimited laterally at an angle of 45° by diagonal fold edges 5 and 6 and which are folded over along bottom side fold lines 9 and 10, to form the closed bottom. When this is done the diagonal fold edges 5 and 6 which delimit the bottom side fold portions 7 and 8 cross at the point of intersection 11, which is positioned in the centre of the cross bottom 1. The corner tucks 3 and 4 which in the present embodiment are free from any coating of adhesive, receive at least one coating 12 and 13 of hot melt material, in strip form, before the bottom side fold portions 7 and 8 are folded over, the end portions of the strips 12, 13 extending across the fold lines 9, 10 of the bottom side fold portions 7, 8 respectively. As an equivalent to a coating of hot melt material use could also be made of for example bitumen or wax, in which the necessary degree of ductile elasticity can be achieved by suitable proportioning of the additives.

Figure 2:
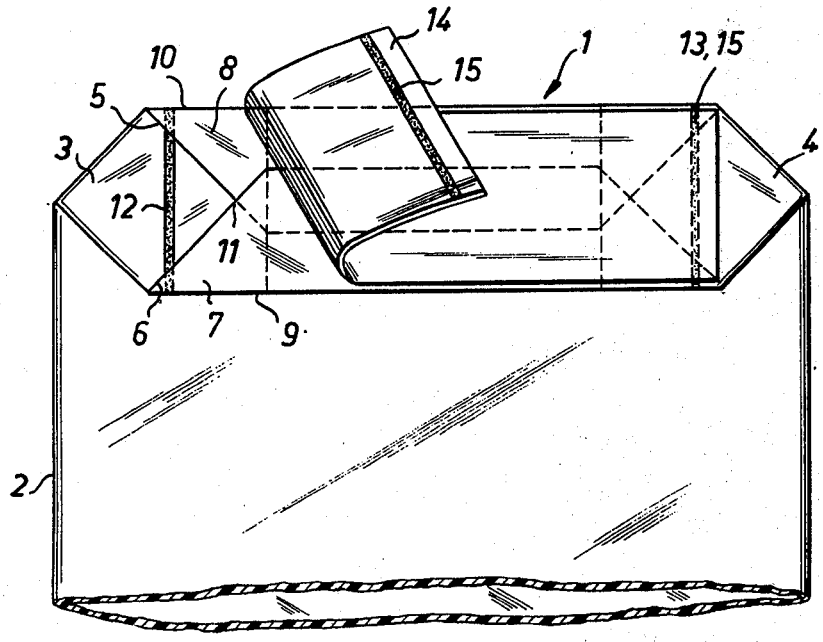
FIG. 2 shows the empty cross-bottom bag lying in a flat condition, after the bottom side fold portions have been folded over, with the bottom cover sheet partly lifted.

As can be seen in particular from FIG. 2, after the bottom side fold portions 7 and 8 have been folded over, a part of the hot melt coating 12 and 13 remains free in the region between the diagonal fold edges 5 and 6 of the bottom side fold portions and the end portions of the strips 12, 13 are doubled back in overlying engagement. In a bag bottom construction known from practical manufacture, the above-mentioned part of the hot melt coating comes directly into contact with a bottom cover sheet 14 which has a coating of adhesive (not shown). In accordance with the invention, the bottom cover sheet 14 is provided with two strips 15 of hot melt material on its side which is directed towards the bottom folds. The strips of hot melt material are of the same composition as the strips 12 and 13. The hot melt coating 15 is of such a contour and is arranged at such a position on the bottom cover sheet 14 that when the sheet 14 is stuck to the bottom folds the hot melt coating 15 comes directly into contact at least with the exposed part of the coatings 12 and 13 on the bottom corner tucks. As can be seen, the hot melt strips 15 are somewhat longer than the exposed part of the strips 12 and 13 so that the strip 15 projects on both sides beyond the diagonal fold edges 5 and 6 of the bottom side fold portions 7 and 8. In practice the hot melt strips 12 and 13 are generally closer to the point 11 of crossing of the diagonal fold edges 5 and 6, than is shown in the drawings, for reasons of clarity thereof.

Even in the event of a bottom valve additionally being provided (this is not shown in the drawing), the sealing of the cross bottom is increased by the additional hot melt coating 15.

Other modes of applying the principle of the invention may be employed, change being made as regards the details described, provided the features stated in any of the following claims, or the equivalent of such be employed.

I, therefore, particularly point out and distinctly claim as my invention:

1. A cross-bottom bag comprising, in combination, a pair of oppositely disposed, inwardly folded corner tucks at one end of the bag, a pair of oppositely disposed, inwardly folded side fold portions at said one end of the bag, said side fold portions having diagonal fold edges extending in overlying relationship with said corner tucks, a bottom cover sheet being adhesively secured in overlying relationship with said folded corner tucks and said folded side portions, a strip of adhesive material of the thermoplastic type on each of said corner tucks, each of said strips having end portions extending in underlying relationship with the diagonal fold edges of said folded side portions and across the fold lines of said side fold portions in doubled-back overlying engagement, each of said strips having an intermediate portion between diagonal fold edges in underlying relationship with said bottom cover sheet and a strip of adhesive material of the thermoplastic type adjacent each end of said bottom cover sheet on said one side in overlying aligned sealing engagement with said respective strips of adhesive material on said corner tucks to form a sealed bottom on the bag.

2. A cross-bottom bag in accordance with claim 1 wherein said strips of adhesive material on said corner tucks and said bottom cover sheet are of the same composition.

* * * * *